US010711998B2

(12) United States Patent
Perez et al.

(10) Patent No.: US 10,711,998 B2
(45) Date of Patent: Jul. 14, 2020

(54) FRESH AIR INTAKE FOR LOW NOX EMISSION FURNACE

(71) Applicant: Lennox Industries, Inc., Richardson, TX (US)

(72) Inventors: Eric Perez, Hickory Creek, TX (US); Randal Poirier, The Colony, TX (US); Eric Chanthalangsy, Grand Prairie, TX (US); Steven Schneider, Plano, TX (US)

(73) Assignee: Lennox Industries Inc., Richardson, TX (US)

( * ) Notice: Subject to any disclaimer, the term of this patent is extended or adjusted under 35 U.S.C. 154(b) by 106 days.

(21) Appl. No.: 15/723,340

(22) Filed: Oct. 3, 2017

(65) Prior Publication Data

US 2019/0101283 A1 Apr. 4, 2019

(51) Int. Cl.

| | |
|---|---|
| ***F23D 14/68*** | (2006.01) |
| ***F23M 11/04*** | (2006.01) |
| ***F23C 9/08*** | (2006.01) |
| ***F23D 14/70*** | (2006.01) |
| ***F23D 14/02*** | (2006.01) |
| ***F23D 14/12*** | (2006.01) |
| ***F23D 14/36*** | (2006.01) |
| ***F23L 5/02*** | (2006.01) |

(Continued)

(52) U.S. Cl.

CPC ..... *F23D 14/68* (2013.01); *F23C 9/08* (2013.01); *F23D 14/02* (2013.01); *F23D 14/10* (2013.01); *F23D 14/12* (2013.01); *F23D 14/36* (2013.01); *F23D 14/70* (2013.01); *F23L 1/00* (2013.01); *F23L 5/02* (2013.01); *F23M 11/042* (2013.01); *F23D 2207/00* (2013.01); *F23D 2900/00011* (2013.01)

(58) Field of Classification Search

CPC ..... F23D 14/68; F23D 14/70; F23D 14/36; F23D 14/02; F23D 14/12; F23D 14/10

See application file for complete search history.

(56) References Cited

U.S. PATENT DOCUMENTS

| | | | | |
|---|---|---|---|---|
| 4,087,234 A | | 5/1978 | Delyannis | |
| 4,515,145 A | * | 5/1985 | Tallman | F24D 19/1084 126/109 |

(Continued)

OTHER PUBLICATIONS

U.S. Appl. No. 15/723,584, Perez, et al.
U.S. Appl. No. 15/723,284, Perez, et al.

*Primary Examiner* — Grant Moubry
*Assistant Examiner* — Rabeeul I Zuberi
(74) *Attorney, Agent, or Firm* — Winstead PC

(57) ABSTRACT

A fresh-air intake according to aspects of the disclosure includes an outer cover having a pair of side panels disposed in a generally parallel spaced relationship, a top panel coupled to, and disposed generally perpendicular to, each panel of the pair of side panels, a bottom panel disposed generally parallel to the top panel, and a front panel coupled to, and disposed generally perpendicular to, each panel of the pair of side panels and the top panel, the front panel having a window formed therein, a supply line coupled to the bottom panel, a weir extending above the bottom panel and surrounding a junction with the supply line, a baffle disposed inside the outer cover, the baffle being disposed inwardly of the window so as to prevent infiltration of moisture into the supply line, and a weep hole formed in the bottom panel.

18 Claims, 7 Drawing Sheets

(51) Int. Cl.
*F23L 1/00* (2006.01)
*F23D 14/10* (2006.01)

(56) References Cited

U.S. PATENT DOCUMENTS

| | | | | | |
|---|---|---|---|---|---|
| 4,541,411 | A | | 9/1985 | Woolf | |
| 4,561,421 | A | * | 12/1985 | Hwang | F24H 3/065 126/110 R |
| 4,900,245 | A | | 2/1990 | Ahmady | |
| 5,311,930 | A | * | 5/1994 | Bruenn | F24C 15/001 126/100 |
| 5,893,358 | A | | 4/1999 | Whitfield | |
| 6,129,628 | A | * | 10/2000 | O'Hagin | F24F 7/02 454/366 |
| 10,281,143 | B2 | | 5/2019 | Batson et al. | |
| 2005/0048430 | A1 | | 3/2005 | Steiner | |
| 2008/0314378 | A1 | | 12/2008 | Khan et al. | |
| 2009/0098496 | A1 | | 4/2009 | Poirier | |
| 2010/0310998 | A1 | * | 12/2010 | Raleigh | F23D 14/58 431/8 |
| 2012/0024281 | A1 | | 2/2012 | Lyons et al. | |
| 2014/0011143 | A1 | | 1/2014 | Barozzi et al. | |
| 2014/0174426 | A1 | * | 6/2014 | Moon | F24C 15/322 126/21 A |
| 2015/0184850 | A1 | | 7/2015 | Seeley | |
| 2015/0192291 | A1 | | 7/2015 | Akbarimonfared et al. | |
| 2016/0102888 | A1 | | 4/2016 | Kuckelkorn et al. | |
| 2017/0241666 | A1 | | 8/2017 | Kowald | |
| 2018/0202652 | A1 | | 7/2018 | Batson et al. | |

* cited by examiner

FRESH AIR INTAKE FOR LOW NOX EMISSION FURNACE

CROSS REFERENCE TO RELATED APPLICATIONS

This patent application incorporates by reference for any purpose the entire disclosure of the U.S. patent application bearing US titled PRE-MIX BURNER ASSEMBLY FOR LOW NOx EMISSION FURNACE. This patent application incorporates by reference for any purpose the entire disclosure of the U.S. patent application bearing US titled BURNER BOX LINER FOR LOW NOx EMISSION FURNACE.

TECHNICAL FIELD

The present disclosure relates generally to furnaces utilized with heating, air conditioning, and ventilation ("HVAC") equipment and more specifically, but not by way of limitation, to pre-mix furnace assemblies utilizing a fresh-air intake that delivers an appropriate amount of atmospheric air to a pre-mix burner for combustion while preventing infiltration of moisture and debris.

BACKGROUND

This section provides background information to facilitate a better understanding of the various aspects of the disclosure. It should be understood that the statements in this section of this document are to be read in this light, and not as admissions of prior art.

Furnaces are common equipment in many commercial and residential HVAC systems. Operation of such furnaces typically includes the controlled combustion of a hydrocarbon fuel such as, for example, propane or natural gas, in the presence of atmospheric air. Theoretically, complete stoichiometric combustion of the hydrocarbon fuel yields carbon dioxide ($CO_2$), water vapor ($H_2O$), Nitrogen ($N_2$), and heat energy. In practice, however, complete stoichiometric combustion of the hydrocarbon fuel rarely occurs due to factors including, for example, combustion residence time and hydrocarbon fuel/air mixture ratio. Incomplete combustion of the hydrocarbon fuel yields combustion byproducts including, for example, carbon monoxide (CO) and various nitrous oxides (NOx). CO and NOx are generally regarded to be environmental pollutants and emissions of byproducts such as CO and NOx are commonly limited by federal, state, and local regulations. NOx, in particular, has recently been the subject of aggressive pollution-reducing agendas in many areas. As a result, manufacturers of furnaces and related HVAC equipment have undertaken efforts to reduce emission of NOx.

SUMMARY

A fresh-air intake according to aspects of the disclosure includes an outer cover having a pair of side panels disposed in a generally parallel spaced relationship, a top panel coupled to, and disposed generally perpendicular to, each panel of the pair of side panels, a bottom panel disposed generally parallel to the top panel, and a front panel coupled to, and disposed generally perpendicular to, each panel of the pair of side panels and the top panel, the front panel having a window formed therein, a supply line coupled to the bottom panel, a weir extending above the bottom panel and surrounding a junction with the supply line, a baffle disposed inside the outer cover, the baffle being disposed inwardly of the window so as to prevent infiltration of moisture into the supply line, and a weep hole formed in the bottom panel.

A fresh-air intake according to aspects of the disclosure includes an outer cover having a window formed in a face thereof, a supply line fluidly coupled to the outer cover, a weir extending above an interior surface of a bottom panel of the outer cover and surrounding a junction with the supply line, a baffle disposed inside the outer cover, the baffle being disposed inwardly of the window so as to prevent infiltration of moisture into the supply line, and a weep hole formed in the bottom panel.

A furnace assembly according to aspects of the disclosure includes an outer cover having a window formed in a face thereof, a supply line fluidly coupled to the outer cover, a weir extending above an interior surface of a bottom panel of the outer cover and surrounding a junction with the supply line, a baffle disposed inside the outer cover, the baffle being disposed inwardly of the window so as to prevent infiltration of moisture into the supply line, a weep hole formed in the bottom panel, a supply line fluidly coupled to the fresh-air intake, an intake manifold fluidly coupled to the supply line, a pre-mix burner fluidly coupled to the intake manifold, a burner box assembly thermally exposed to the pre-mix burner, a heat-exchange tube fluidly coupled to the burner box assembly, and a fan fluidly coupled to the heat-exchange tube.

This summary is provided to introduce a selection of concepts that are further described below in the detailed description. This summary is not intended to identify key or essential features of the claimed subject matter, nor is it to be used as an aid in limiting the scope of the claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Various embodiments will now be described more fully with reference to the accompanying drawings. The disclosure may, however, be embodied in many different forms and should not be construed as limited to the embodiments set forth herein.

During operation of a furnace, production of NOx is typically dependent upon factors including, for example, hydrocarbon fuel/air mixture ratio and residence time. In general, combustion of a lean hydrocarbon fuel/air mixture (e.g. greater than approximately 50% excess air) is desired. Additionally, a well-mixed hydrocarbon fuel/air mixture with a low residence time is desirable for low NOx production and emission. "Residence time" refers to a probability distribution function that describes the amount of time a fluid element could spend inside a chemical reactor such as, for example, a combustion chamber.

Most residential and commercial HVAC equipment utilize induced draft "atmospheric" burners. Atmospheric burners are characterized by an initial mixing of atmospheric air and the hydrocarbon fuel. This is typically accomplished by entraining the atmospheric air into the hydrocarbon fuel stream via, for example, a venturi or other similar device. Atmospheric burners typically operate with a rich hydrocarbon fuel/air mixture and often exhibit a relatively large flame volume. The large flame volume increases combustion residence times, which allows further NOx production to occur. Additionally, combustion in atmospheric burners typically occurs in the presence of excess air. The excess air helps to cool off the products of combustion and spreads the combustion process over a larger area. The flame is typically drawn or induced in by a combustion air blower into a heat exchanger. Long combustion times leads to the creation of excess levels of NOx.

Another type of furnace utilizes a pre-mix burner. Pre-mix burners are fan powered, which allows the hydrocarbon fuel/air mixture ratio to be carefully controlled in an effort to prevent combustion with excess air. Pre-mix burners operate with a lean hydrocarbon fuel/air mixture and often exhibit short blue flames. Pre-mix burners exhibit short reaction zones and high burning velocities. This leads to short residence time and high combustion efficiency, which limits NOx production and emission.

Figure 1A:
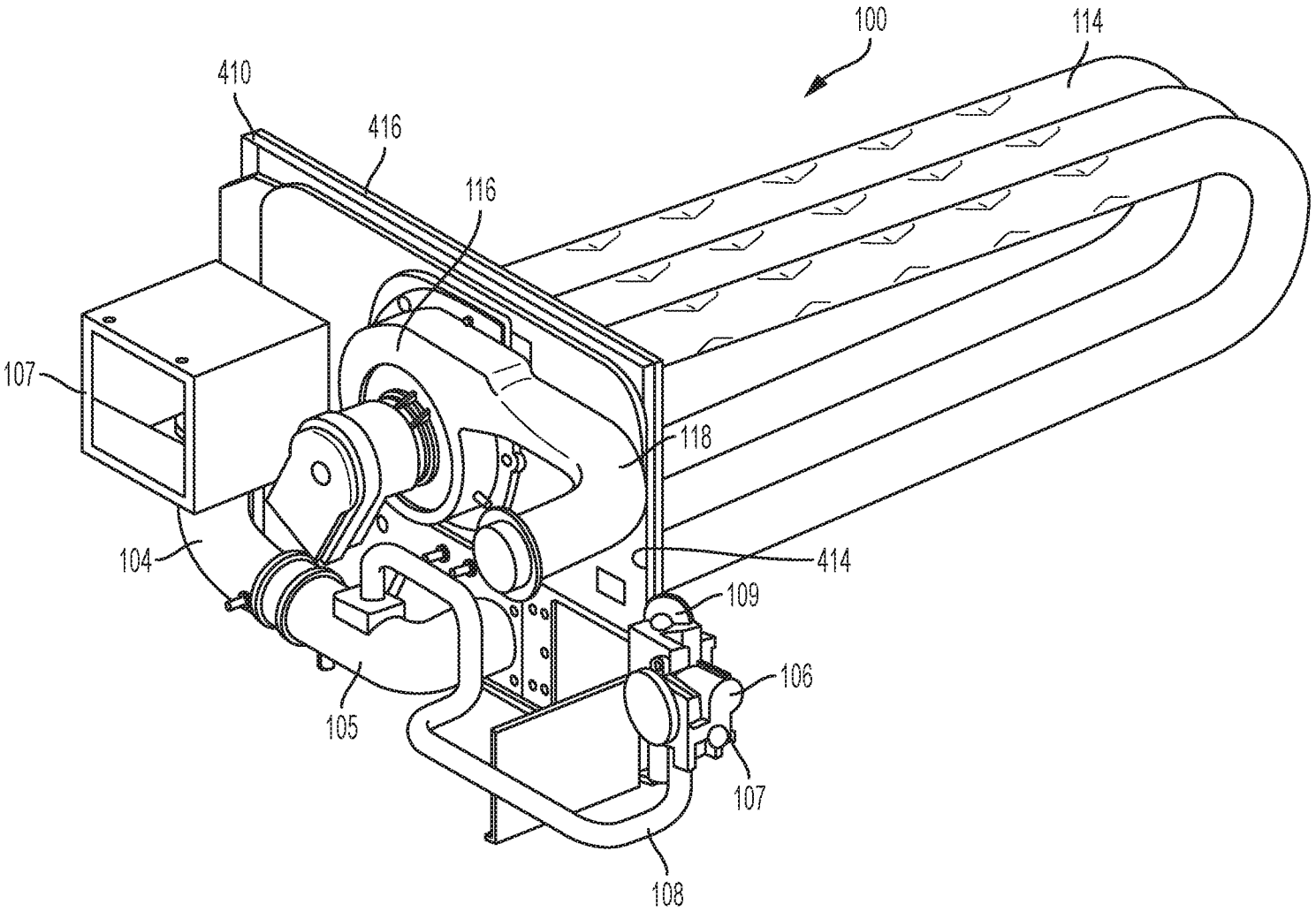
FIG. 1A is a perspective view of an illustrative furnace assembly implementing a fresh-air intake in accordance with aspects of the disclosure.

FIG. 1A is a perspective view of an illustrative furnace assembly 100 implementing a fresh-air intake 102 in accordance with aspects of the disclosure. The furnace assembly 100 includes a fresh-air intake 102 that is fluidly coupled to a supply line 104. The supply line 104 is fluidly coupled to an intake manifold 105. A fuel valve 106 regulates a volume of hydrocarbon fuel that is supplied to a fuel tube 108. The fuel valve 106 is, for example, an electrically-actuated solenoid valve that opens or closes responsive to an electrical current being applied to a terminal 107 of the fuel valve 106. The fuel valve 106 includes a fuel inlet 109. The fuel inlet is fluidly coupled to, for example, a supply of a hydrocarbon fuel. The fuel tube 108 supplies the hydrocarbon fuel to the intake manifold 105. In the intake manifold 105, the hydrocarbon fuel mixes with atmospheric air supplied through the fresh-air intake 102 and the supply line 104 to form a hydrocarbon fuel/air mixture. A fan 116 is fluidly coupled to an exhaust manifold 118. The fan 116 is fluidly coupled to a heat-exchange tube 114. The fan 116 is, for example a squirrel-cage blower; however, in other embodiments, other types of fans could be utilized.

Figure 1B:
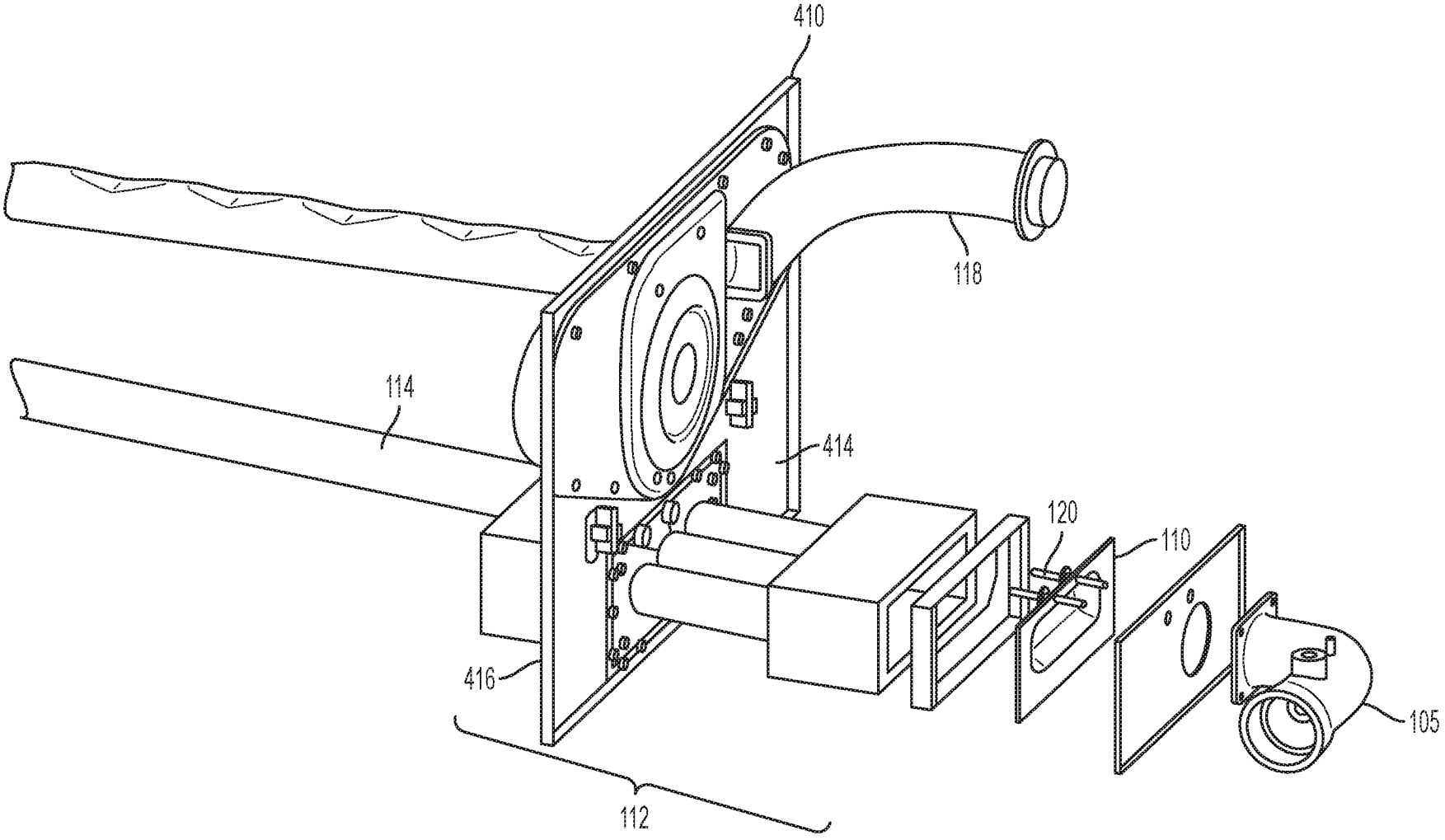
FIG. 1B is an exploded perspective view of the illustrative furnace assembly.

FIG. 1B is an exploded perspective view of the illustrative furnace assembly 100. The heat-exchange tube 114 is fluidly coupled to a burner box assembly 112 that is thermally exposed to a pre-mix burner 110. The pre-mix burner 110 is fluidly coupled to the intake manifold 105. During operation, the fan 116 draws the hydrocarbon fuel/air mixture through the intake manifold 105 and through the pre-mix burner 110. During operation, the fan 116 controls the mixture ratio of hydrocarbon fuel to atmospheric air to ensure that combustion in excess air is minimized. A low NOx premix combustion system, such as the furnace assembly 100, requires a gas-air linkage to maintain a consistent gas-air ratio. The supply line 104 includes a venturi arranged in a coupling upstream of the intake manifold 105. During operation, the venturi pressure is communicated to the fuel valve 106 through pressure tubing. The fuel valve 106 and a speed of the fan 116 are modulated according to the measured venturi pressure thereby maintaining the proper amount of excess air for combustion. In other embodiments, the pressure in the supply line 104 could be measured electronically using, for example, a pressure transducer. Reducing combustion in excess air reduces production and emission of NOx. Igniters 120 combust the hydrocarbon fuel/air mixture at the pre-mix burner 110. The igniters 120 utilize an electrical spark to combust the hydrocarbon fuel/air mixture; however, the igniters 120 could utilize, for example, a hot surface or a pilot flame to combust the hydrocarbon fuel/air mixture. The burner box assembly 112 is thermally exposed to the pre-mix burner 110 and contains the combustion of the hydrocarbon fuel/air mixture. The fan 116 continues to draw hot combustion byproducts through the heat-exchange tube 114 and into the exhaust manifold 118. In this manner, the furnace assembly 100 exhibits short combustion residence time when compared to atmospheric burners, which contributes to low NOx production and emission. From the exhaust manifold 118, the combustion byproducts are exhausted to the exterior environment.

Figure 2:
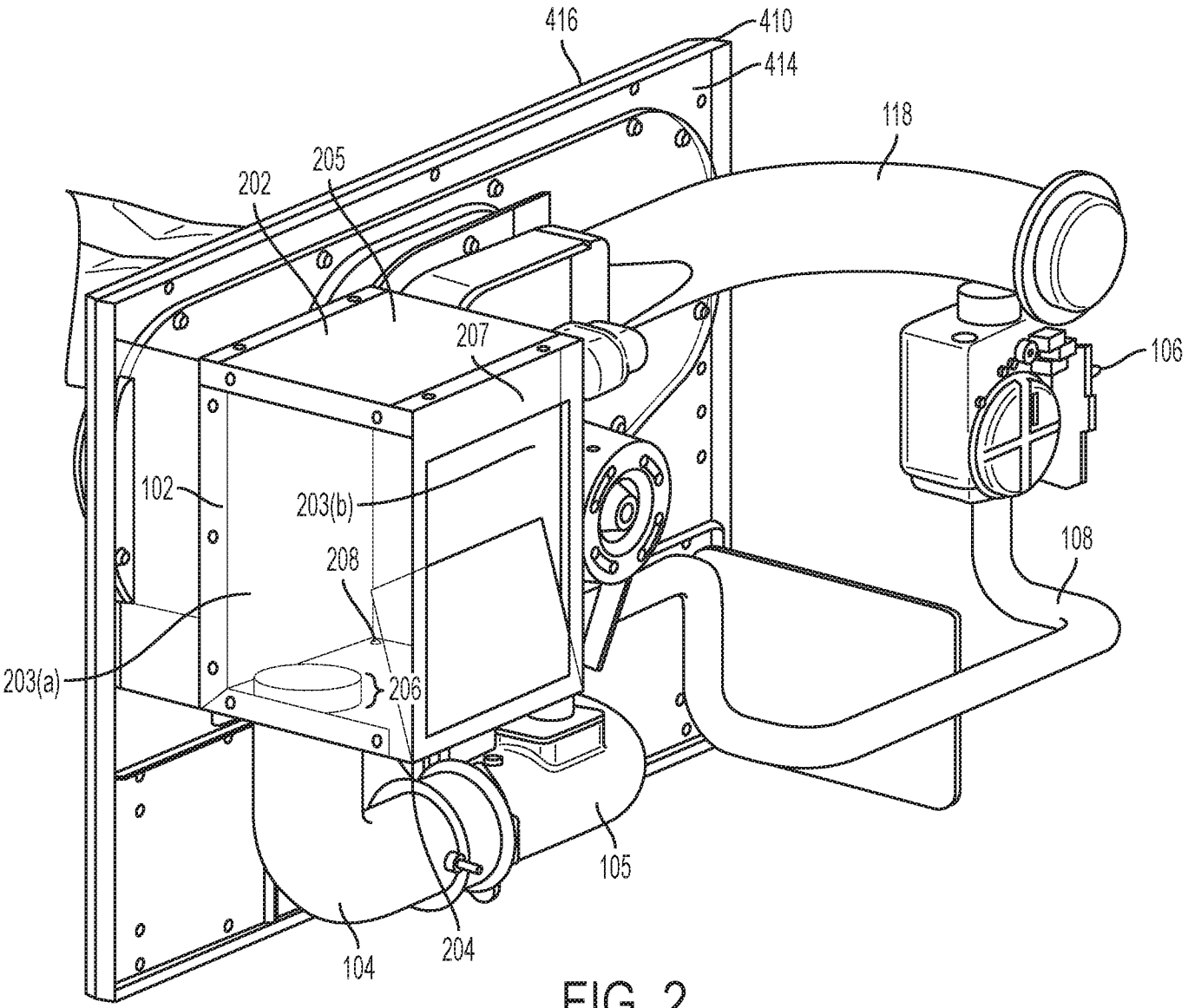
FIG. 2 is a perspective view of the illustrative furnace assembly showing internal details of an illustrative fresh-air intake.

FIG. 2 is a perspective view of the illustrative furnace assembly 100 showing internal details of an illustrative fresh-air intake 102 in accordance with one or more aspects of the disclosure. For purposes of illustration, FIG. 2 is discussed herein relative to FIGS. 1A-1B. The fresh-air intake 102 includes an outer cover 202. The outer cover 202 includes a pair of oppositely-disposed spaced side panels 203(*a*) and 203(*b*). A top panel 205 is coupled to each panel of the pair of oppositely-disposed spaced side panels 203(*a*) and 203(*b*). A bottom panel 204 is coupled to each panel of the pair of oppositely-disposed spaced side panels 203(*a*) and 203(*b*) and is arranged generally parallel to the top panel 205. A front panel 207 is coupled to each panel of the pair of oppositely-disposed spaced side panels 203(*a*) and 203(*b*), the top panel 205, and the bottom panel 204. The outer cover 202 is constructed of a weather-resistant, corrosion-resistant material such as, for example, galvanized, aluminized, or painted steel or heat and weather resistant plastic. The supply line 104 interfaces with the bottom panel 204 and protrudes upwardly through the bottom panel 204 such that a weir 206 is formed on an interior surface of the bottom panel 204 at a junction with the supply line 104. The weir 206 is formed by a section of the supply line 104 that protrudes through the bottom panel 204 into an interior of the outer cover 202. In other embodiments, the weir 206 may be, for example, a ring-shaped element that is coupled to the interior surface of the bottom panel 204 so as to surround the junction with the supply line 104. In use, the weir 206 prevents infiltration of any accumulated moisture such as, for example, rainwater and snow, into the supply line 104. In various embodiments, a height of the weir 206 may vary according, for example, a climate of a particular location where the furnace assembly 100 is installed. For instance, if the furnace assembly 100 is installed in a location with a particularly moist climate due, for example, to frequent rainfall or large amounts of snow accumulation, the weir 206 may be formed with a larger height to allow more moisture accumulation in the outer cover 202 than if the furnace assembly 100 were installed in a location with a drier climate. A weep hole 208 is formed in the bottom panel 204 to facilitate drainage of accumulated moisture from the outer cover 202.

Figure 3:
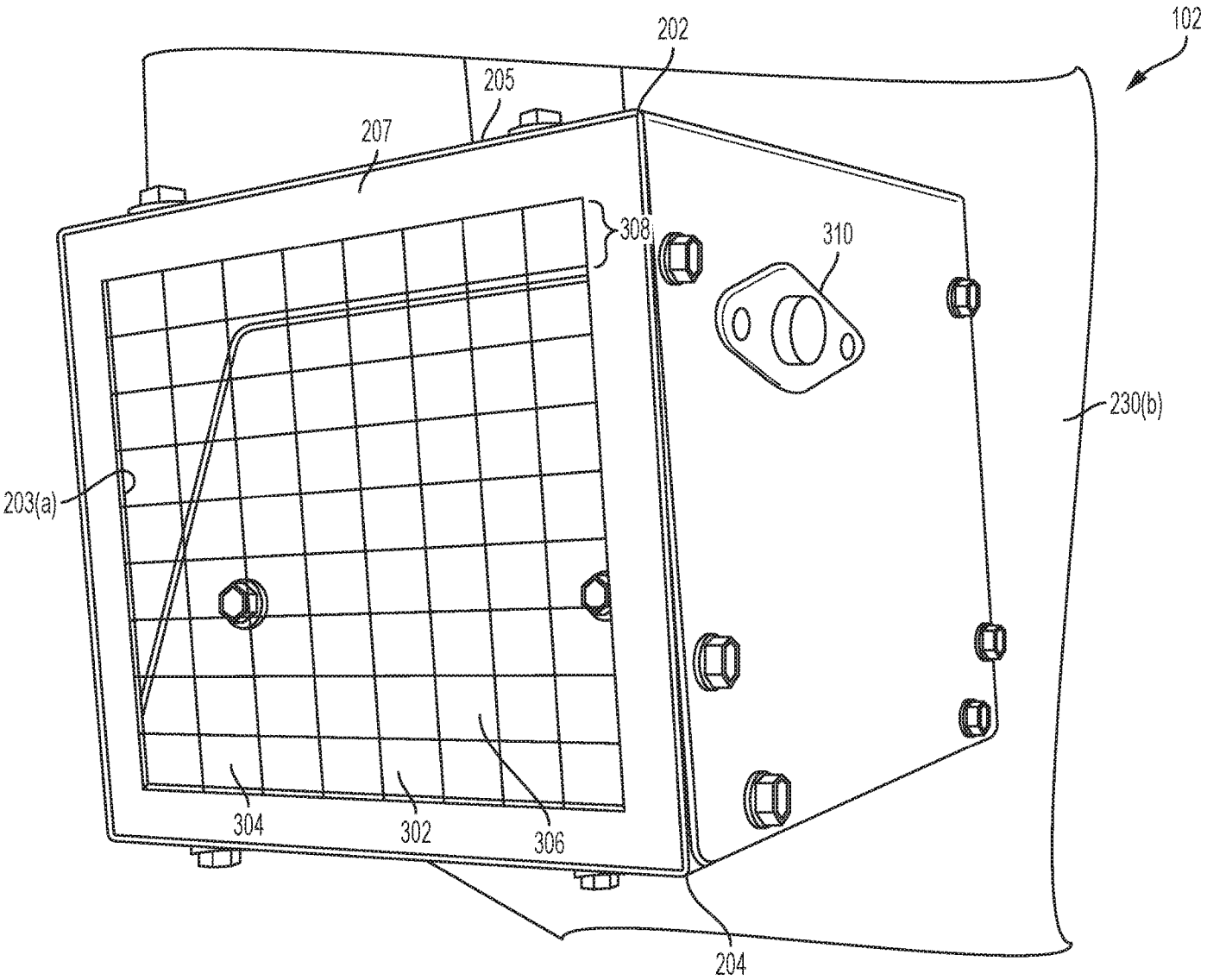
FIG. 3 is a perspective view of the illustrative fresh-air intake.

FIG. 3 is a perspective view of the illustrative fresh-air intake 102 in accordance with one or more aspects of the disclosure. A window 302 is formed in the front panel 207 of the outer cover 202. For purposes of illustration. FIG. 3 is discussed herein relative to FIGS. 1A-2. As illustrated in FIGS. 2-3, the window 302 is formed in the front panel 207 of in a face of the outer cover 202 that faces away from the heat-exchange tube 114. However, the window 302 could be formed in any face of the outer cover 202 so as to facilitate access to atmospheric air; however, in operation, the window 302 should be positioned so as to limit infiltration of, for example, rainwater, into the outer cover 202. A grid 304 is coupled to the outer cover 202 across the window 302. The grid 304 is a mesh or a screen constructed of a weather-resistant non-corrosive material. The grid 304 prevents infiltration of solid debris such as, for example, dirt, insects, and plant material into the outer cover 202. In an embodiment, the grid 304 is approximately 44% open with an approximately 0.028 inch plain weave 304 stainless steel screen. Such solid debris, if allowed to infiltrate the supply line 104, can become captured by components of the pre-mix burner 110 and eventually foul the pre-mix burner 110. In this manner the grid 304 prolongs a service life of the pre-mix burner 110 and reduces maintenance and cleaning requirements associated with the pre-mix burner 110.

Still referring to FIG. 3, a baffle 306 is disposed in an interior of the outer cover 202. The baffle 306 is formed of a weather-resistant and corrosion resistant material. In various embodiments, the baffle 306 is formed of the same material as the outer cover 202. A lower aspect of the baffle 306 is coupled to the bottom panel 204 at a point close to the window 302. The baffle 306 extends in an angled fashion upwardly and inwardly into the outer cover 202 so as to provide a barrier to materials such as, for example, rainwater, or snow, entering the outer cover 202 through the window 302. An air gap 308 is defined by an upper edge of the baffle 306 and an interior surface of the top panel 205 of the outer cover 202. When, for example, rainwater strikes the baffle 306, the angled arrangement of the baffle 306 directs the rainwater out of the outer cover 202 through window 302. The baffle 306 is constructed with a height relative to the outer cover 202 sufficient to prevent entry of, for example, rainwater and snow; however, the baffle 306 is sized such that the air gap 308 is of a size sufficient to allow intake of an adequate amount of atmospheric air into the outer cover 202. Similar to the weir 206, the height of the baffle 306 may be varied according, for example, the climate of the particular location where the furnace assembly 100 is installed.

Still referring to FIG. 3, a temperature switch 310 is disposed in the fresh-air intake 102. The temperature switch 310 includes a bi-metallic strip that is formed of two materials having different coefficients of thermal expansion. Changes in temperature of the atmospheric air entering the fresh-air intake 102 thus induces thermal expansion of at least one of the materials in the bi-metallic strip thereby causing the bi-metallic strip to flex in a predictable manner according to temperature. In other embodiments, the temperature switch could include, for example, a thermistor, or a non-contact infrared heat sensor to measure the temperature of air entering the fresh-air intake 102. Such a sensor could be mounted in front of or inside the fresh-air intake 102 or in the supply line 104. The temperature switch 310 is electrically coupled to the fan 116. During operation of the furnace assembly 100, if the ambient temperature of the atmospheric air exceeds a pre-defined threshold, the temperature switch 310 interrupts electrical current to the fan 116 thereby deactivating or partially limiting the operation of the furnace assembly 100. High combustion temperature is a common failure mode of a pre-mix furnace system. High temperatures of ambient intake air reduce the density of the intake air and make it more difficult to optimize the ratio of air to hydrocarbon fuel to achieve optimal operation of the furnace assembly 100. Additionally, electrical components such as, for example, motors, variable-speed electronics, and gas valves are sensitive to elevated temperatures and can fail prematurely if allowed to operate at high ambient temperatures. By deactivating or reducing the speed of the fan 116, the amount of hydrocarbon fuel burned is also limited thereby reducing temperatures in the burner compartment.

Figure 4A:
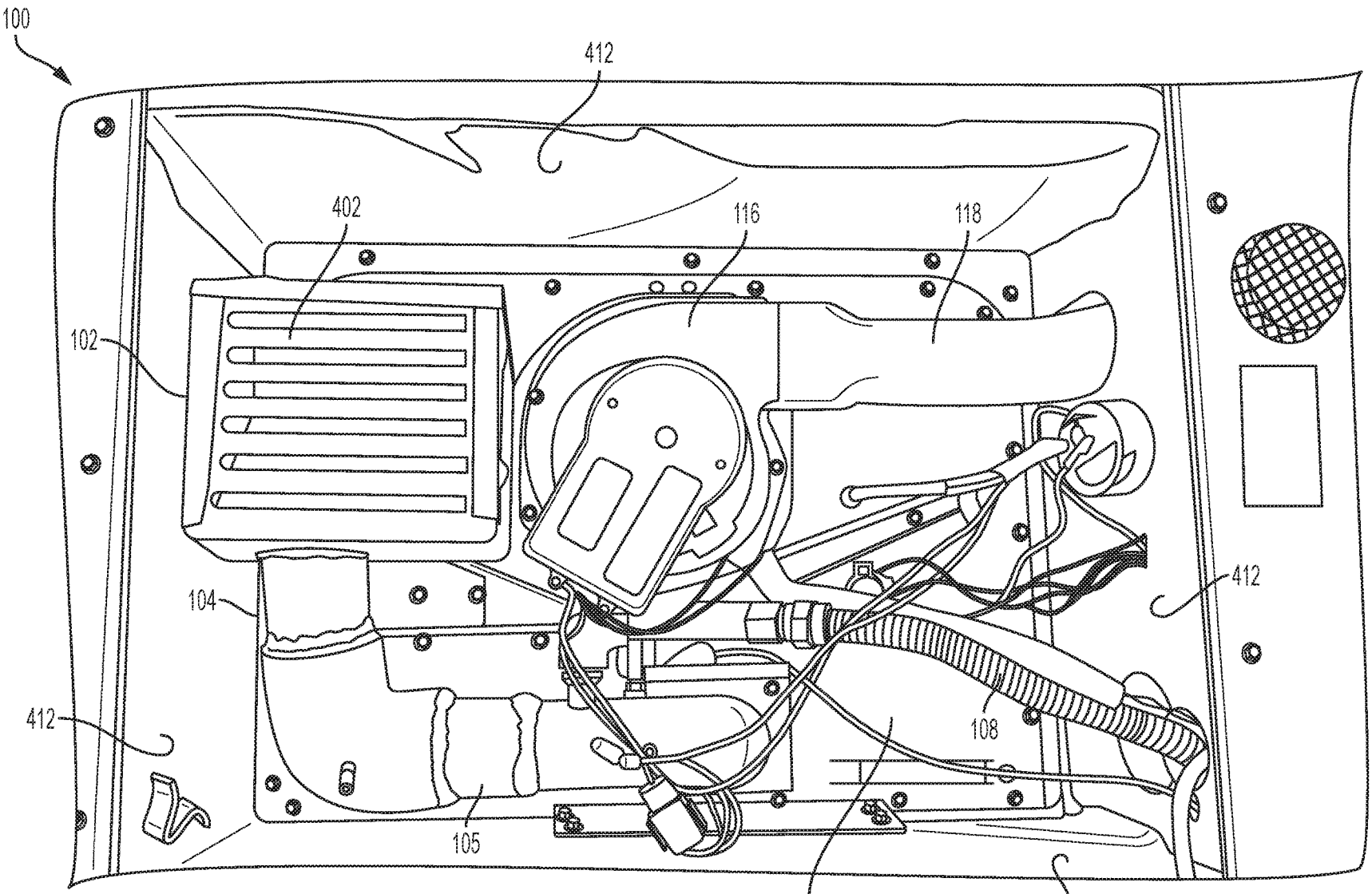
FIG. 4A is a front view of an installed furnace assembly with an exterior cover removed.

FIG. 4A is a front view of an installed furnace assembly 100 with an exterior cover 404 (shown in FIG. 4B) removed in accordance with one or more aspects of the disclosure. For purposes of illustration, FIG. 4A is discussed herein relative to FIGS. 1A-3. The fresh-air intake 102, the supply line 104, the intake manifold 105, the fuel tube 108, the fan 116, and the exhaust manifold 118 are disposed on a first side 414 of a barrier 410. The pre-mix burner 110, the burner box assembly 112, and the heat-exchange tube 114 are disposed on a second side 416 of the barrier opposite the first side 414. A housing 412 is coupled to the barrier 410 so as to contain the fresh-air intake 102, the supply line 104, the intake manifold 105, the fuel tube 108, the fan 116, and the exhaust manifold 118. The housing 412 facilitates installation of the furnace assembly 100 as a single, integral unit together with the fresh-air intake 102. Such an arrangement simplifies installation by eliminating separate installation of individual components of the furnace assembly 100. A louver panel 402 is coupled to the outer cover 202 so as to cover the window 302 and the grid 304 and further prevent infiltration of debris into the outer cover 202.

Figure 4B:
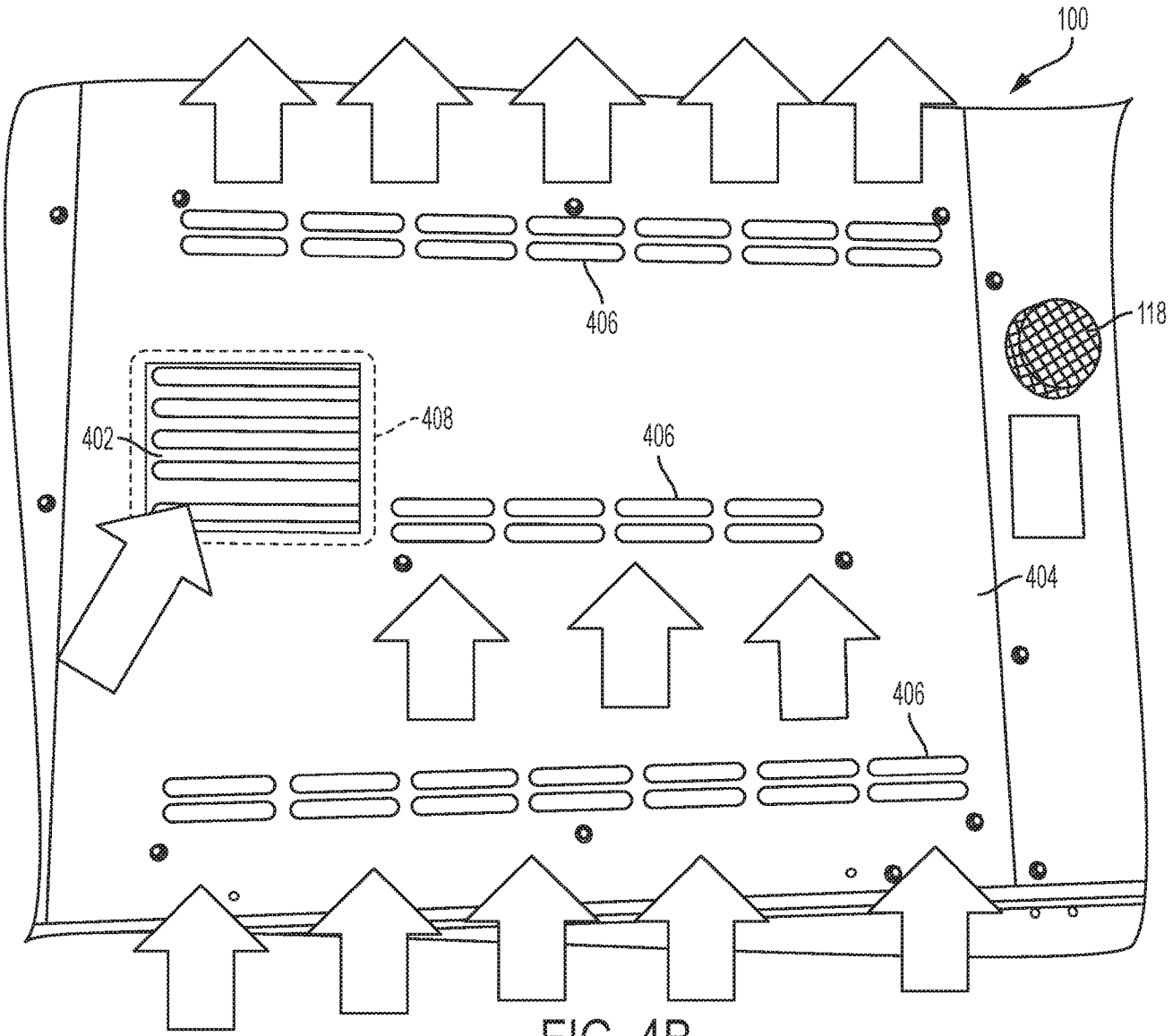
FIG. 4B is a front view of an installed furnace assembly showing an exterior cover.

FIG. 4B is a front view of the installed furnace assembly 100 showing an exterior cover 404 in accordance with one or more aspects of the disclosure. For purposes of illustration, FIG. 4B is discussed herein relative to FIGS. 1A-4A. The exterior cover 404 is coupled the housing 412 and is positioned so as to conceal the components of the furnace assembly 100. The exterior cover 404 includes ventilation slots 406 formed therein. The ventilation slots 406 facilitate circulation of atmospheric air around components of the furnace assembly 100. The exterior cover 404 has an opening 408 formed therein and sized to receive the louver panel 402. When the exterior cover 404 is installed, the louver panel 402 fits into the opening 408. Such an arrangement simplifies assembly of the fresh-air intake 102 and the exterior cover 404. The louver panel 402 creates draft ventilation by drawing fresh air into the bottom of the burner box where the fresh air keeps component temperatures down. The louver panel 402 also allows heat to escape from the furnace assembly 100. Additionally, the louver panel 402 prevents rain and snow from entering the furnace assembly 100.

Figure 5:
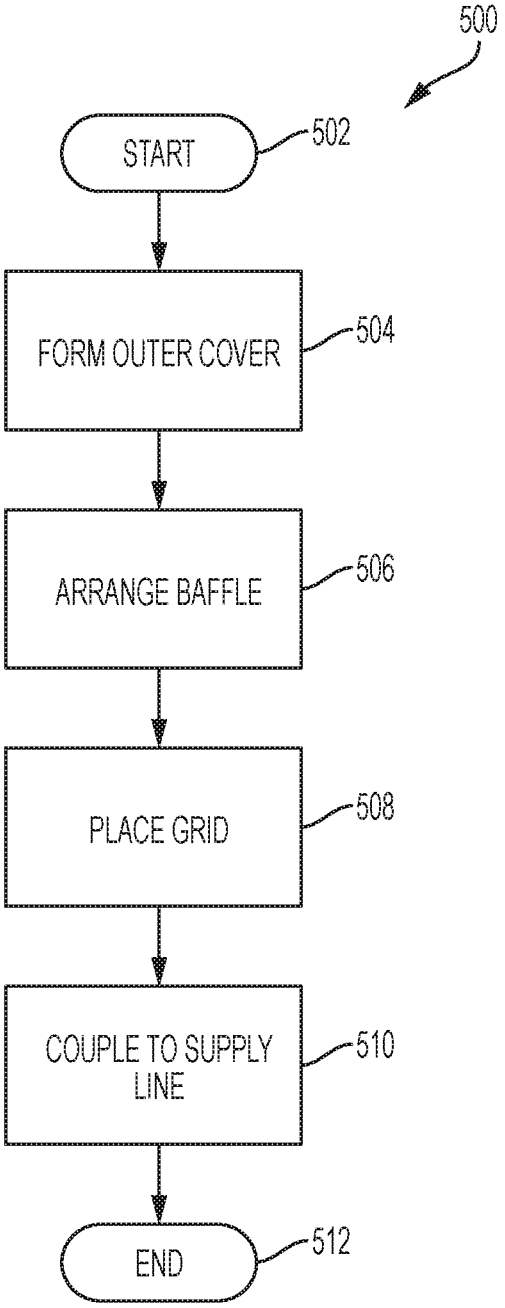
FIG. 5 is a flow diagram of an illustrative process for forming a fresh-air intake.

FIG. 5 is a flow diagram of an illustrative process 500 for forming the fresh-air intake 102 in accordance with one or more aspects of the disclosure. For purposes of illustration, FIG. 5 is discussed herein relative to FIGS. 1A-4B. The process 500 begins at block 502. At block 504, the outer cover 202 is formed. At block 506, the baffle 306 is disposed in the outer cover 202 inwardly of the window 302. At block 508, the grid 304 is disposed across the window 302 of the outer cover 202. At block 510, the outer cover 202 is coupled to the supply line 104. Coupling of the outer cover 202 to the supply line 104 forms the weir 206. In other embodiments, the weir 206 may be separately coupled to an interior surface of the bottom panel so as to surround a junction with the supply line 104. The process 500 ends at block 512.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined by the language of the claims that follow. The term "comprising" within the claims is intended to mean "including at least" such that the recited list of elements in a claim are an open group. The terms "a," "an," and other singular terms are intended to include the plural forms thereof unless specifically excluded.

What is claimed is:

1. A furnace fresh-air intake comprising:

an outer cover comprising:

a pair of side panels disposed in a spaced generally-parallel relationship;

a top panel coupled to, and disposed generally perpendicular to, each panel of the pair of side panels;

a bottom panel disposed generally parallel to the top panel and coupled to each panel of the pair of side panels; and a front panel coupled to, and disposed generally perpendicular to, each panel of the pair of side panels and the top panel, the front panel having a window formed therein;

a supply line fluidly coupled to the bottom panel;

a weir extending above the bottom panel and surrounding a junction with the supply line;

a baffle disposed inside the outer cover, the baffle having an angled arrangement directed towards an opening of the supply line into a space defined by the outer cover and disposed upwardly and inwardly of the window providing a barrier so as to prevent infiltration of moisture into the supply line and to direct moisture outwardly from the window, wherein the baffle is connected at alunction of the bottom panel and the front panel;

wherein the angled arrangement provides for an air gap formed by an upper edge of the baffle and an interior surface of the top panel of the outer cover; and a weep hole formed in the bottom panel.

2. The fresh-air intake of claim 1, wherein the weir is formed by a section of the supply line protruding through the bottom panel to an interior of the outer cover.

3. The fresh-air intake of claim 1, comprising a grid disposed across the window.

4. The fresh-air intake of claim 1, comprising a temperature switch disposed inside the outer cover.

5. The fresh-air intake of claim 4, comprising:

a fan fluidly coupled to the outer cover;

the temperature switch is electrically coupled to the fan;

the temperature switch interrupts electrical current to the fan responsive to a temperature of atmospheric air entering the outer cover exceeding a pre-defined threshold; and the temperature switch limits a furnace hydrocarbon fuel input, thereby reducing heating input and burner temperatures below a defined threshold.

6. The fresh-air intake of claim 1, wherein the weir prevents infiltration of liquid into the supply line.

7. The fresh-air intake of claim 1, wherein the weep hole drains accumulated moisture from the outer cover.

8. A furnace fresh-air intake comprising:

an outer cover having a front panel comprising a window formed in a face thereof;

a supply line fluidly coupled to the outer cover;

a weir extending above an interior surface of a bottom panel coupled to a pair of side panels of the outer cover and surrounding a junction with the supply line;

a baffle disposed inside the outer cover, the baffle having an angled arrangement directed towards an opening of the supply line into a space defined by the outer cover and disposed upwardly and inwardly of the window providing a barrier so as to prevent infiltration of moisture into the supply line and to direct moisture outwardly from the window, wherein the baffle is connected at a junction of the bottom panel and the front panel;

wherein the angled arrangement provides for an air gap formed by an upper edge of the baffle and an interior surface of a top panel coupled to the pair of side panels of the outer cover; and a weep hole formed in the bottom panel.

9. The fresh-air intake of claim 8, comprising a grid disposed across the window.

10. The fresh-air intake of claim 8, comprising a temperature switch disposed inside the outer cover.

11. The fresh-air intake of claim 10, wherein the temperature switch comprises a temperature sensor.

12. The fresh-air intake of claim 10, wherein:

a fan fluidly coupled to the outer cover;

the temperature switch is electrically coupled to the fan; and the temperature switch interrupts electrical current to the fan responsive to a temperature of atmospheric air entering the outer cover exceeding a pre-defined threshold.

13. The fresh-air intake of claim 8, wherein the weir prevents infiltration of liquid into the supply line.

14. The fresh-air intake of claim 8, wherein the weep hole drains accumulated moisture from the outer cover.

15. A furnace assembly comprising:

a fresh-air intake comprising:

an outer cover, the outer cover having a front panel comprising a window formed in a face thereof;

a supply line fluidly coupled to the outer cover;

a weir extending from an interior surface of a bottom panel coupled to a pair of side panels of the outer cover and surrounding a junction with the supply line;

a baffle disposed inside the outer cover, the baffle having an angled arrangement directed towards an opening of the supply line into a space defined by the outer cover and disposed upwardly and inwardly of the window providing a barrier so as to prevent infiltration of moisture into the supply line and to direct moisture outwardly from the window, wherein the baffle is connected at a junction of the bottom panel and the front panel;

wherein the angled arrangement provides for an air gap formed by an upper edge of the baffle and an interior surface of a top panel coupled to the pair of side panels of the outer cover; and a weep hole formed in the bottom panel;

an intake manifold fluidly coupled to the supply line;

a pre-mix burner fluidly coupled to the intake manifold;

a burner box assembly thermally exposed to the pre-mix burner;

a heat-exchange tube fluidly coupled to the burner box assembly; and a fan fluidly coupled to the heat-exchange tube.

16. The furnace assembly of claim 15, comprising a barrier, the fresh-air intake and the fan being disposed on a first side of the barrier.

17. The furnace assembly of claim 16, comprising a housing coupled to the first side of the barrier, the housing surrounding the fresh-air intake and the fan.

18. The furnace assembly of claim 15, wherein:

an exterior cover is coupled to a housing, the housing surrounding the fresh-air intake and the fan; and a louver panel disposed over the window, the louver panel being received into an opening formed in the exterior cover, the louver panel facilitating venting of heat from the furnace assembly and introduction of air into the fresh-air intake.

* * * * *